US009070293B2

(12) United States Patent
Roeber et al.

(10) Patent No.: US 9,070,293 B2
(45) Date of Patent: Jun. 30, 2015

(54) DEVICE AND METHOD FOR TRAFFIC SIGN RECOGNITION

(75) Inventors: Marc Roeber, Duesseldorf (DE); Dirk Gunia, Pulheim (DE); Torsten Wey, Moers (DE); Gerald Doerne, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 51 days.

(21) Appl. No.: 13/593,032

(22) Filed: Aug. 23, 2012

(65) Prior Publication Data

US 2013/0049988 A1 Feb. 28, 2013

(30) Foreign Application Priority Data

Aug. 24, 2011 (DE) ..... 10 2011 081 456

(51) Int. Cl.
*G08G 1/09* (2006.01)
*G08G 1/0962* (2006.01)
*G08G 1/0967* (2006.01)

(52) U.S. Cl.
CPC ..... *G08G 1/09623* (2013.01); *G08G 1/0967* (2013.01)

(58) Field of Classification Search
CPC ..... G08G 1/0967; G08G 1/096716
USPC ..... 340/905, 917
See application file for complete search history.

(56) References Cited

U.S. PATENT DOCUMENTS 6,472,977 B1 10/2002 Poechmueller
8,050,460 B2 11/2011 Mueller-Schneiders et al.
2004/0143381 A1* 7/2004 Regensburger et al. ..... 701/36
2009/0034798 A1 2/2009 Mueller-Schneiders et al.
2009/0312888 A1* 12/2009 Sickert et al. ..... 701/1
2011/0109476 A1* 5/2011 Porikli et al. ..... 340/905
2011/0176002 A1* 7/2011 Bury ..... 348/148

FOREIGN PATENT DOCUMENTS

DE 3619824 A1 12/1987
DE 29610677 U1 9/1996
DE 29802953 U1 5/1998
DE 19736774 A1 2/1999
DE 19829162 A1 1/2000
EP 1327969 A1 7/2003
EP 2023265 A1 2/2009

* cited by examiner

*Primary Examiner* — Tai T Nguyen
*Assistant Examiner* — Zhen Y Wu
(74) *Attorney, Agent, or Firm* — Frank A. MacKenzie; Brooks Kushman P.C.

(57) ABSTRACT

A method and apparatus for determining whether to alert a driver of a vehicle to the presence of a traffic sign in the vehicle's driving environment. An optical system on-board the vehicle detects the traffic sign and determine information related to the sign. Driving maneuvers carried out by the vehicle are monitored to determine driving situation information. The driving situation information and the traffic sign information are used to determine a probability that the sign is pertinent for the vehicle under the current driving conditions. If the probability is above a threshold, the driver is alerted to the traffic sign. The probability of the pertinence of the traffic sign may be further determined on the basis of lane-specific information such as vehicle position relative to a freeway exit ramp start or end, or performance of a lane change by the vehicle.

13 Claims, 1 Drawing Sheet

DEVICE AND METHOD FOR TRAFFIC SIGN RECOGNITION

CROSS-REFERENCE TO RELATED APPLICATIONS

This application claims foreign priority benefits under 35 U.S.C. §119(a)-(d) to DE 10 2011 081 456.6, filed Aug. 24, 2011, which is hereby incorporated by reference in its entirety.

TECHNICAL FIELD

The present invention relates to a device and a method for optical traffic sign detection and driver alerting.

BACKGROUND

In order to support the driver of a motor vehicle in fulfilling his tasks in road traffic, methods for automatic traffic sign recognition and driver alerting with the aid of a suitable optical-based detection system have recently been developed and brought onto the market by diverse original parts manufacturers and by manufacturers of portable navigation units.

Portable navigation systems are typically based on signals from satellite-based systems (GPS, Galileo, GLONASS, etc.) in conjunction with map data in order to supply the driver with information regarding traffic signs (as recorded in the map data base). Other proposed systems make use of a camera-based optical recognition in order to improve the recognition and robustness. In contrast thereto, the vehicle manufacturers themselves chiefly make use of front view camera devices and signal combination with data that relate to the current driving state of the vehicle. Signal combination with navigation devices is also proposed as an option.

In many cases speed restrictions and signs for regulating overtaking maneuvers after the respective road has been left no longer pertain to a vehicle and hence are no longer valid. Alerting of the driver to such traffic information therefore becomes superfluous after turning-off maneuvers. Furthermore, exit ramps, particularly on freeways, have associated speed restrictions that frequently occur as a sequence of maximum speeds decreasing in stepwise fashion. However, when the respective exit ramp is not used by the driver, incorrect speed restrictions are communicated to the driver.

The above described limitations are more or less strongly pronounced, depending on the concept respectively realized in the particular case. Said limitations are to be considered in particular in this case when the aim is to dispense with the combination of a plurality of detection devices. On the other hand, the use of only a single environmental detection device is preferred from the point of view of cost, and also in order to increase the detection rates of the respective traffic sign recognition system.

Whereas the recognition of traffic signs by means of a camera or with the aid of navigation devices is generally known, there is to date no known effective and practical filtering and suppressing logic for solving the above described problems.

SUMMARY

In a first disclosed embodiment, a method comprises operating an optical system on-board a vehicle to detect a traffic sign and determine information related to the sign, determining driving situation information of the vehicle, and using the driving situation information along with the sign information to determine a probability that the sign is pertinent for the vehicle in view of the current driving situation. If the probability of pertinence is above a threshold level, the presence of the sign is communicated to the driver. If the probability of pertinence is below the threshold level, the presence of the sign is not communicated to the driver.

The sign information may comprise at least one of a type of sign, a limit value prescribed by the sign, a position of the sign, and a restriction of the sign defined by an additional sign.

The driving situation information may comprise at least one of a driving speed, a yaw rate, a steering wheel angle, a status of a vehicle navigation system, and a distance travelled by the vehicle.

The probability of the pertinence of the traffic sign is further determined in on the basis of lane-specific information. The lane specific information may be, for example, related to at least one of a freeway exit ramp start and a freeway exit ramp end or related to performance of a lane change by the vehicle.

In another disclosed embodiment, a method of determining whether to alert a driver of a vehicle to a traffic sign comprises operating an optical system on-board the vehicle to detect the traffic sign and determine information related to the sign, monitoring driving maneuvers carried out by the vehicle to determine driving situation information, and using the driving situation information and the traffic sign information to determine a probability that the sign is pertinent for the vehicle. If the probability is above a threshold, the driver is alerted to the traffic sign.

In another disclosed embodiment, apparatus for determining whether the presence of a traffic sign is to be communicated to a driver of a vehicle comprises a camera system detecting the traffic sign and generating traffic sign information, a vehicle system generating driving situation information, and a recognition module receiving the traffic sign information from the camera and receiving the driving situation information from the vehicle system. The recognition module determining from the traffic sign information and the driving situation information a probability that the traffic sign is pertinent for the vehicle, and communicates presence of the traffic sign to the driver if the probability is above a threshold level.

BRIEF DESCRIPTION OF THE DRAWINGS

Embodiments of the present invention described herein are recited with particularity in the appended claims. However, other features will become more apparent, and the embodiments may be best understood by referring to the following detailed description in conjunction with the accompanying drawings, in which:

DETAILED DESCRIPTION

Figure 1:
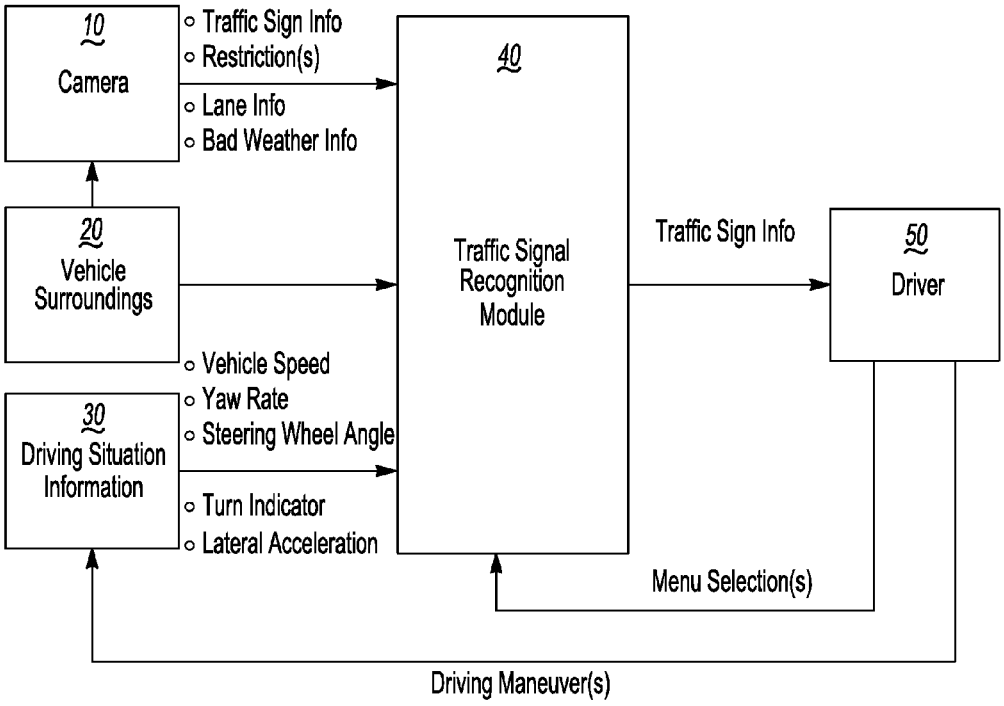
FIG. 1 is a block diagram for explaining the design and the function of an inventive device.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The disclosed apparatus and method is based on the concept of rejecting and/or suppressing recognized traffic signs as a function of a) the vehicle/driver behavior and b) the lane information, it being possible to attain a high traffic sign coverage in the vehicle environment (in the sense of a large driving distance or range for which traffic sign information is still displayed), as well as a high detection rate (in the sense of a large driving distance or range with correctly displayed traffic sign information). In particular, an advantageous and developed use of a camera functionality with functional overreach, as well as of vehicle sensor information is implemented, in particular, in order to relate the driving behavior to recognized and/or displayed traffic signs as well as, if appropriate, to available information regarding the lane conditions.

Merely by way of example (and without restricting the invention hereto) reference is made below to a subgroup of traffic signs, specifically speed limits, if appropriate with information relating to specific restrictions.

In particular, the disclosed method defines a suppression or filtering logic that determines in accordance with the following equation (1) the probability that a detected traffic sign is pertinent to the host vehicle under the current situation, this being dependent on at least the driving situation (DS) and the recognized traffic sign ($TS_n$), for example ignoring traffic signs at exit ramps:

$$p_{TS}=f(TS_n,DS) \quad (1)$$

A detected traffic sign can be accepted (considered pertinent) or rejected (not non-pertinent) depending on whether or not the determined probability reaches/exceeds a threshold value. A pertinent traffic sign is displayed or otherwise communicated to the vehicle driver (audibly or haptically, for example), while a non-pertinent sign is not communicated to the driver. In some cases, a detected traffic sign that cannot be immediately rejected is discarded depending on the further conditions such as exit ramp situations.

In accordance with the following equation (2), the traffic sign information TS. can comprise data relating to the type (T) of traffic sign, a limit value (V) prescribed by the traffic sign, and a position (P) of the traffic sign. Possible restrictions (q), which are typically described in the form of additional signs, can be provided on the respective traffic sign. Restrictive traffic signs such as, for example, exit lane arrows, are used in order to define the probability value more precisely.

$$TS_n=f(T, V, P, q) \quad (2)$$

In accordance with the following equation (3), the information that refers to the driving situation DS of the vehicle containing the system (the host vehicle) can comprise the driving speed (v), the yaw rate (Y), the steering wheel angle (SWA), the status of a vehicle navigation system (TI), and the distance or route travelled by the vehicle (x).

$$DS=f(Y,TSE,v,LI,SWA,TI,x) \quad (3)$$

In addition, it is possible to use lane-specific data which include further features in the form of lane information (LI). Use is made of freeway exit ramp start (ERS) and freeway exit ramp end (ERE) as well as lane change information, which are usually available from lane keeping/departure warning algorithms that run in the front view camera. The camera should additionally supply information relating to the traffic style (right-hand traffic/left-hand traffic) by means of a traffic style estimation (TSE) algorithm, if these data are not available on the vehicle bus.

In accordance with FIG. 1 a device for a traffic sign firstly uses a front camera system 10 to detect traffic sign information ($TS_n$), including any restrictions relevant to the traffic sign, which are typically prescribed in the form of additional signs, and also detects information relating to the vehicle surroundings 20 (such as lane information and weather information). Together with driving situation information 30 (which depends on the driving maneuvers carried out by the vehicle and, for example, comprises driving speed v, yaw rate Y, steering wheel angle SWA, status of the vehicle navigation system TI, and/or distance or route x covered) is fed to a Traffic Sign Recognition (TSR) module 40 for estimating the probability of pertinence of the relevant traffic sign, which unit 40 decides, based on comparison of the probability with a threshold, whether the traffic sign is communicated to the driver 50 or suppressed.

Figure 2:
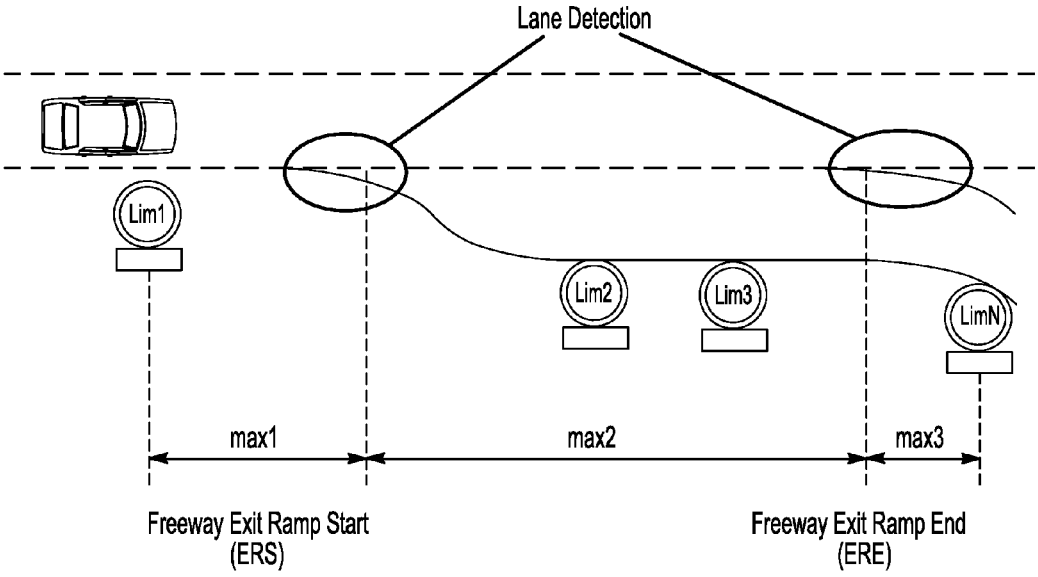
FIG. 2 is a schematic diagram of a freeway exit ramp for illustrating an example of the application of the invention.

The following functionalities can be implemented in one exemplary disclosed embodiment, reference being made to FIG. 2 for illustration.

In accordance with one embodiment, speed limit signs can be interpreted as referring to a freeway exit ramp when the following conditions are fulfilled (the variables subsequently named being illustrated in FIG. 2):

all speed limits are located on the right-hand side (in the case of right-hand traffic; the reverse is true for left-hand traffic);

first optional speed limit (Lim1) before freeway exit ramp start (ERS) is not more distant than max1 from this freeway exit ramp start;

maximum distance between freeway exit ramp start (ERS) and freeway exit ramp end (ERE)=max2; and last optional speed limit (LimN) after freeway exit ramp end (ERE) not more distant than max3.

The traffic sign recognition device (TSR module) should suppress all speed limits related to the freeway exit ramp when there has been no turning off onto the freeway exit ramp, that is to say:

when the vehicle does not change lane; or when the vehicle undertakes a lane change to the left.

The speed limits are handled as usual as long as the vehicle has not turned off onto the freeway exit ramp and other speed limit signs are detected, specifically:

only on the left-hand side as speed limit; or on both sides as speed limit.

The traffic sign recognition device should communicate the speed limit sign referring to a freeway exit ramp that has last been passed, as soon as there has been a turn off onto the freeway exit ramp, specifically:

when the vehicle undertakes a lane change to the right; or when the driver operates the driving direction turn signal to the right.

As soon as a turn off has been made onto the freeway exit ramp, all subsequent traffic signs are handled as usual.

Finally, the traffic sign recognition device can discard speed limit signs referring to a freeway exit ramp as soon as the freeway exit ramp end (ERE) has been left.

When no freeway exit ramp end ERE has been detected (for example by a lane detection module or the lane departure warning) within the defined distance max2, the last recognized traffic signs are communicated to the driver in accordance with the usual rule.

In accordance with a further aspect, it is also possible to suppress speed limits that are extremely implausible for specific speeds. When, for example, the imaging device detects a speed limit of 30 km/h while the vehicle is being driven at a speed of 110 km/h, the communication of the 30 km/h speed limit can be suppressed because of the high differential speed.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of determining whether to alert a driver of a vehicle to a speed limit sign adjacent to a roadway comprising:

operating an optical system on-board the vehicle to a) identify a start and an end of an exit ramp adjacent to the roadway, and b) detect a speed limit sign-;

monitoring driving maneuvers carried out by the vehicle to determine driving situation information;

determining, based on a position of the sign relative to at least one of the start and the end of the exit ramp, whether the sign applies only to the exit ramp;

using the driving situation information to determine whether the vehicle is turning off onto the exit ramp; and suppressing a driver alert related to the speed limit sign if it is determined that a) the sign applies only to the exit ramp and b) the vehicle is not turning off onto the exit ramp.

2. The method of claim 1 wherein the driving situation information comprises at least one of a driving speed, a yaw rate, a steering wheel angle, a status of a vehicle navigation system, and a distance travelled by the vehicle.

3. The method of claim 1 wherein the determination whether the vehicle is turning off onto the exit ramp is related to performance of a lane change by the vehicle.

4. The method of claim 1 wherein the determination whether the vehicle is turning off onto the exit ramp is related to operation of a turn signal by the driver.

5. Apparatus for determining whether presence of a traffic sign is to be communicated to a driver of a vehicle comprising:

a camera system a) identifying an exit ramp start (ERS) and an exit ramp end (ERE) adjacent to a roadway on which the vehicle is travelling, and b) detecting the traffic sign and generating traffic sign information;

a vehicle system generating driving situation information; and a recognition module operative to: receive the traffic sign information from the camera, receive the driving situation information from the vehicle system, determine therefrom that a) based on a position of the traffic sign relative to at least one of the ERS and the ERE that the traffic sign applies only to the exit ramp and b) that the vehicle is turning off onto the exit ramp, and communicate presence of the traffic sign to the driver only upon the determinations a) and b) above.

6. The apparatus of claim 5 wherein the camera system further serves as part of a lane keeping system.

7. The apparatus of claim 5 wherein the sign information comprises at least one of a type of sign, a limit value prescribed by the sign, a position of the sign, and a restriction of the sign defined by an additional sign.

8. The apparatus of claim 5 wherein the driving situation information comprises at least one of a driving speed, a yaw rate, a steering wheel angle, a status of a vehicle navigation system, and a distance travelled by the vehicle.

9. The apparatus of claim 5 wherein the determination that the vehicle is turning off onto the exit ramp is based at least in part on performance of a lane change by the vehicle.

10. The apparatus of claim 5 wherein the determination that the vehicle is turning off onto the exit ramp is based at least in part on operation of a turn signal by the driver.

11. A method comprising:

operating an optical system on-board a vehicle to detect: a) an exit ramp having a start and an end spaced from one another by a distance, and b) a speed limit sign and a position of the sign relative to the exit ramp;

determining driving situation information of the vehicle;

operating an traffic sign recognition module to determine that a) based on the position of the sign relative to the exit ramp the sign applies only to the exit ramp, and b) based on the driving situation information the vehicle is not turning off onto the exit ramp; and if the driving situation information indicates the vehicle is not turning off onto the exit ramp, suppressing communication of presence of the sign to a vehicle driver.

12. The method of claim 11 wherein the driving situation information comprises at least one of a driving speed, a yaw rate, a steering wheel angle, a status of a vehicle navigation system, and a distance travelled by the vehicle.

13. The method of claim 11 further comprising:

operating the optical system to detect an additional traffic sign, and wherein the determination that the sign applies only to the exit ramp is further based upon a restriction of the speed limit sign defined by the additional sign.

* * * * *